US006321051B1

(12) United States Patent
Lee

(10) Patent No.: US 6,321,051 B1
(45) Date of Patent: Nov. 20, 2001

(54) APPARATUS FOR CLEANING OPC DRUM IN IMAGE FORMING DEVICE

(75) Inventor: Hyun-Cheol Lee, Seoul (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/603,539

(22) Filed: Jun. 26, 2000

(30) Foreign Application Priority Data

Jun. 24, 1999 (KR) ..... 99-23880

(51) Int. Cl.[7] ..... G03G 15/24
(52) U.S. Cl. ..... 399/111; 399/149; 399/150
(58) Field of Search ..... 399/98, 111, 149, 399/150, 350, 351

(56) References Cited

U.S. PATENT DOCUMENTS 5,333,041 * 7/1994 Ito et al. ..... 399/149
5,563,691 * 10/1996 Hayakawa et al. ..... 399/149
5,822,659 * 10/1998 Ishiyama ..... 399/150 X
6,128,456 * 10/2000 Chigono et al. ..... 399/150 X

* cited by examiner

*Primary Examiner*—William J. Royer
(74) *Attorney, Agent, or Firm*—Robert E. Bushnell, Esq.

(57) ABSTRACT

A process and an apparatus for cleaning an organic photosensitive drum in an image forming apparatus including a developer housing formed with an exposure window at a desired portion thereof and contained therein with an organic photosensitive drum, a developing roller, and a charging roller, the developing roller being configured to recover toner particles left on an outer surface of the organic photosensitive drum, for reuse thereof. The drum cleaning apparatus includes a cleaning film arranged between the charging roller and the exposure window while being in contact with the outer surface of the organic photosensitive drum, the cleaning film serving to remove foreign matters affixed to the outer surface of the organic photosensitive drum.

16 Claims, 5 Drawing Sheets

APPARATUS FOR CLEANING OPC DRUM IN IMAGE FORMING DEVICE

CLAIM OF PRIORITY

This application makes reference to, incorporates the same herein, and claims all benefits accruing under 35 U.S.C. §119 from my application APPARATUS FOR CLEANING OPC DRUM IN IMAGE FORMING DEVICE filed with the Korean Industrial Property Office on the 24$^{th}$ day of the month of June 1999 and there duly assigned Ser. No. 23880/1999.

BACKGROUND OF THE INVENTION

1. Field of the Invention

The present invention relates to processes and apparatus for cleaning a photosensitive drum in an image forming device such as a laser beam printer, a light emitting diode printer, a facsimile machine, or a digital copying machine, and, more particularly, to a process and apparatus for cleaning an organic photosensitive (OPC) drum in an image forming device, of foreign matter adhering to the surface of the OPC drum.

2. Description of the Related Art

Image forming devices such as laser beam printers, LED printers, facsimile machines, or digital copying machines are devices for transferring, in the form of a visual image, an image signal resulting from a digital signal received from a computer or a scanner. In an image forming and printing procedure, a developing device operates to form an electrostatic latent image in response to a digital image signal received, and then to attach toner particles to the electrostatic latent image, thereby forming a toner image. The formed image is transferred to a copy sheet, that is, a printing medium. The copy sheet is then heated to permanently affix the toner image thereto. As the initial digital image signal is outputted in a form affixed to the copy sheet, the image forming and printing procedure is completed. Electrophotographic processors typically require a separate waste toner receiving space for toner residue removed from the surface of the OPC drum. The waste toner receiving space increases the volume of the developer, and hinders efforts to achieve compactness of the design of the electrophotographic processor. Recent design efforts have eliminated the cleaning blade used to remove the residual toner. Particles left on the OPC drum are recovered by a developing roller for reuse. Although toner particles remain on the surface of the OPC drum while in a negatively charged state, and can be reused after being recovered by the developing roller, foreign matter attached to the sheet of paper passing through the nip between the drum and the transfer roller are not in a negatively charged state and can not be recovered by the developing roller. Such foreign matter may adhere to the surface of the OPC drum and create undesired white spots on the printed image. As a result, a degradation in printing quality occurs. This adversely affects the performance of the electrophotographic processor, thereby severely degrading the reliability of the electrophotographic processor.

SUMMARY OF THE INVENTION

It is therefore, an object of the present invention to provide an improved image formation process and apparatus.

It is another object to provide a process and an apparatus for cleaning an OPC drum in an image forming device.

It is yet another object to provide a process and an apparatus able to print matter exhibiting an enhanced quality.

It is still another object to provide a process and an apparatus for the drum of an image formation device that is capable of minimizing degradation of printing quality attributable to the adherence of foreign matter to the surface of the drum.

It is still yet another object to provide a process and an apparatus for improving the reliability of the electrophotographic processor with a device that cleans the OPC drum in the processor.

It is a further object to provide a process and apparatus capable of printing matter with a high image quality with a concomitant enhancement in performance, and a resulting improvement in operational reliability.

These and other objects may be accomplished by equipping an image forming apparatus constructed with a developer housing formed with an exposure window and an organic photosensitive drum, a developing roller, and a charging roller situated within the housing. The developing roller is configured to recover toner residual particles from the outer circumferential surface of the organic photosensitive drum, for reuse. A device for cleaning the organic photosensitive drum may be constructed with a component blade positioned between the charging roller and the exposure window while contacting the outer surface of the organic photosensitive drum, so that the component blade removes foreign matter adhering to the outer surface of the organic photosensitive drum. In accordance with the principles of the present invention, the component blade for removing foreign matter may be constructed with a film that has a proximal end fixedly mounted on an inner wall of the exposure window, and a distal end of the film contacting the outer surface of the organic photosensitive drum. Preferably, the film is arranged in such a fashion that the distal end of the film maintains an orientation at an angle within a range of between approximately 30° to 45° with respect to a vertical line passing through the center of the organic photosensitive drum. Also preferably, the film may extend throughout the length of the outer surface of the organic photosensitive drum. The film is preferably made of urethane and has a thickness of 0.1 to 1.5 mm.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
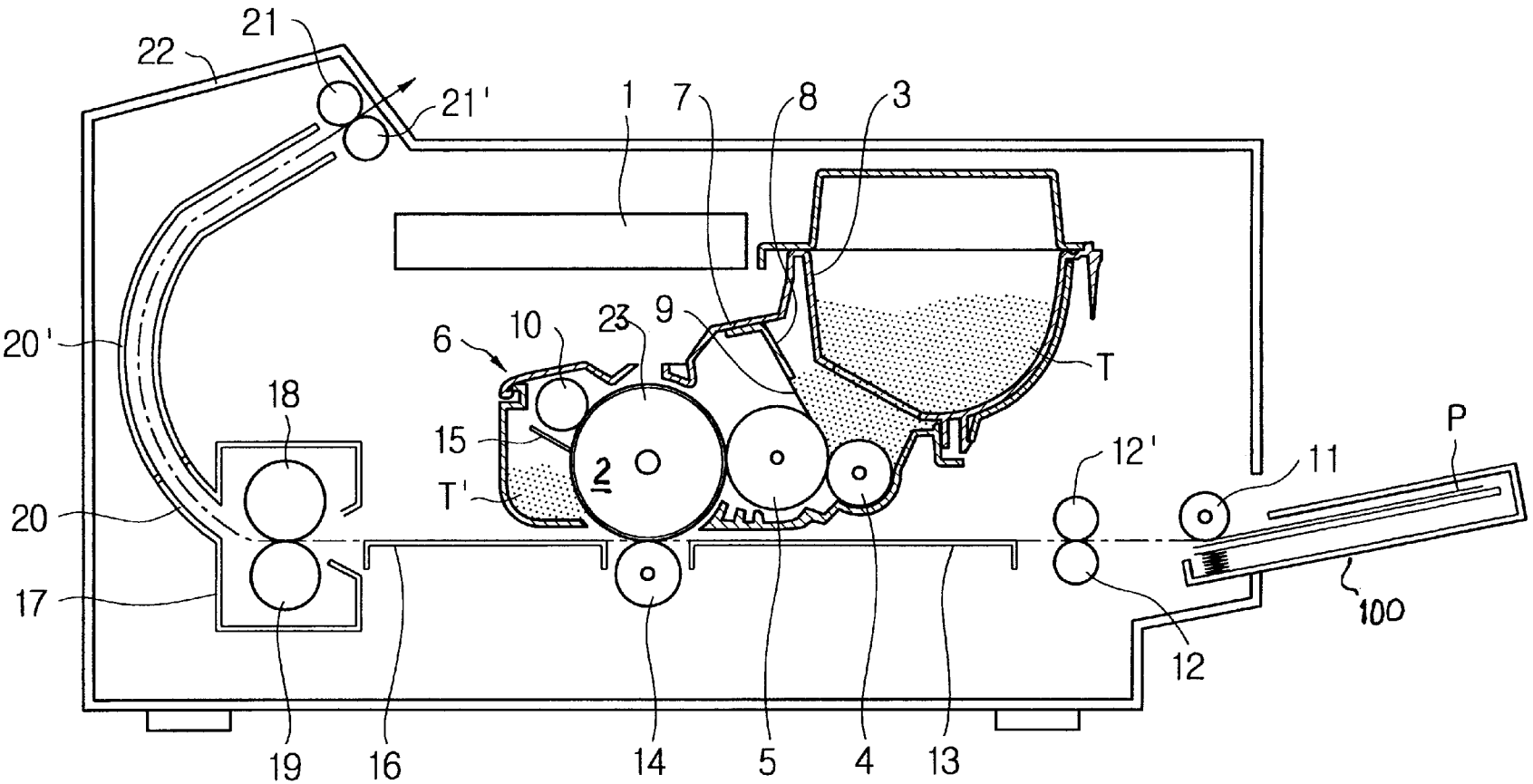
FIG. 1 is a schematic cross-sectional elevational view illustrating the configuration of an electrophotographic processor incorporated into an image forming device.
Figure 2:
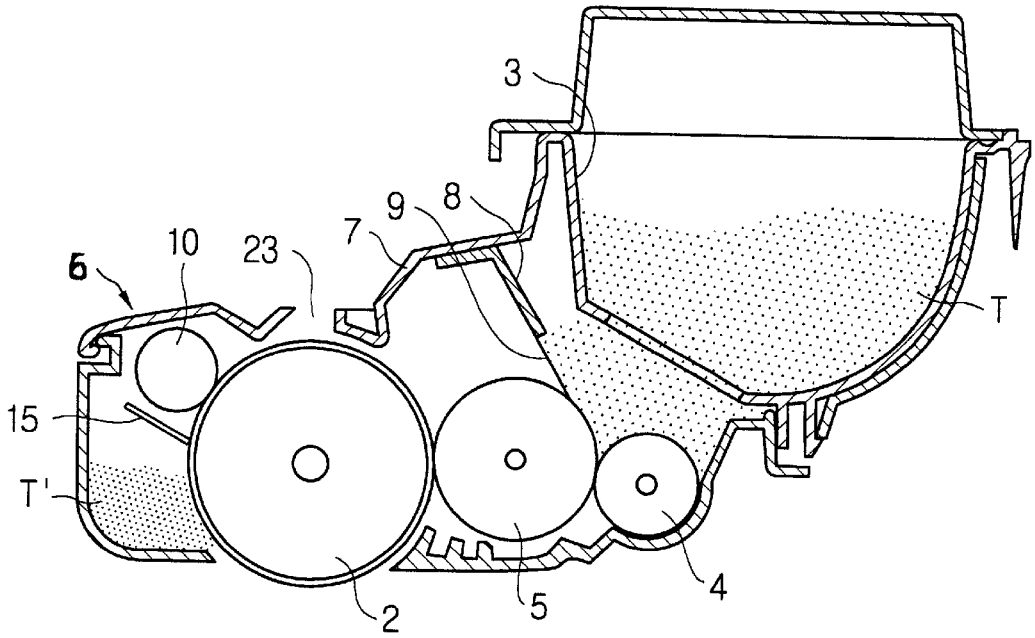
FIG. 2 is a sectional view illustrating a configuration of the image forming device shown by FIG. 1.

Turning now to the drawings and referring to FIGS. 1 and 2, typically, image forming devices such as laser beam printers, light emitting diode (i.e., LED) printers, facsimile machines, as well as digital copying machines are image formation devices for transferring, in the form of a visual image, an optically or electrically transmitted image signal derived from a digital signal received from a computer, a scanner or a digital camera. In the typical image forming and printing procedure, a developing device forms an electrostatic latent image in response to reception of a digital image signal, and then attaches toner particles to the electrostatic latent image, thereby forming a toner image. The formed image is transferred onto a copy sheet, that is, a printable medium such as a cut sheet of paper, Mylar or card stock. The copy sheet is then heated to permanently affix the toner image to its surface. When the initial digital image signal is discharged in a form affixed to the copy sheet, the image forming and printing procedure is completed.

First, a digital signal, which is inputted from a computer or a scanner, is converted into an optical signal by a laser scanning unit or LED array 1. Based on the optical signal, an electrostatic latent image is formed on an OPC drum 2. At this time, toner particles T contained in a toner hopper 3 are fed to a developing roller 5 by a supply roller 4 while being negatively charged by the supply roller 4. As the developing roller 5 rotates, the toner particles T are fed to a developing nip formed between the tangential exterior circumferential surfaces between OPC drum 2 and developing roller 5. A doctor blade 9, which serves as a toner layer regulator, is attached to a bracket 8 mounted within developer housing 7 of a developer cartridge 6 in such a fashion that blade 9 extends toward the developing roller 5. Doctor blade 9 serves to maintain a toner layer of a constant thickness on the exterior circumferential surface of developing roller 5.

As OPC drum 2 rotates, it attracts, at the nip, the negatively charged toner particles T which are maintained in the form of a layer with a uniform thickness on developing roller 5 by the doctor blade 9. As a result, a visual toner image is formed on the surface of the OPC drum 2. The formation of the visual toner image on the OPC drum 2 is achieved because the exterior circumferential surface of the OPC drum 2 is electrically uniformly discharged in accordance with the discharging operation of a charging roller 10, and by virtue of the potential difference that occurs between the surface region of the OPC drum that is exposed to the optical signal scanned by the laser scanning unit or LED array 1, and the surface region of the OPC drum that is not exposed to the optical signal.

Meanwhile, copy sheets P (e.g., cut sheets of a printable medium) stored in a stack in sheet supply cassette 100 are withdrawn and then supplied, one-by-one, to the OPC drum 2 by the rotation of supply roller 11. A copy sheet P emerging from sheet supply cassette 100 is then fed to a pair of registration rollers 12 and 12' that are positioned on opposite sides of a path of conveyance of sheet P from cassette 100 to OPC drum 2, so that the forward movement of copy sheet P along the path of conveyance is synchronized with a laser scanning unit, or LED array, 1 by the operation of the registration rollers 12 and 12'. After synchronization, copy sheet P is fed along a feeding guide 13 to a transfer nip defined between the tangential exterior circumferential surfaces of OPC drum 2 and transfer roller 14. When the copy sheet P enters the transfer nip, the toner image attached to the OPC drum 2 is transferred to the copy sheet P by virtue of an electrostatic force generated in accordance with an air breakdown phenomenon that occurs due to the high voltage applied to the transfer roller 14 (or a corona device). The toner particles attached to the surface of the OPC drum 2 are incompletely transferred to the copy sheet P. The remaining toner particles on the OPC drum 2 should be subsequently removed by a cleaning blade 15 that is positioned upstream from the charging roller 10, so that they are collected, as waste toner particles T', in the bottom portion of the The copy sheet P, to which the toner image from the OPC drum 2 has been transferred, is fed along a feeding guide 16 to a fixing unit 17. In fixing unit 17, the toner image is affixed to the copy sheet P by heat and pressure generated respectively by heating roller 18 and pressing roller 19. Subsequently, the copy sheet P bearing the toner image is discharged outwardly from the body 22 of the electrophotographic device via a pair of discharge guides 20, 20' and a pair of discharge rollers 21, 21', thereby completing the entire operation of the electrophotographic processor.

Figure 3:
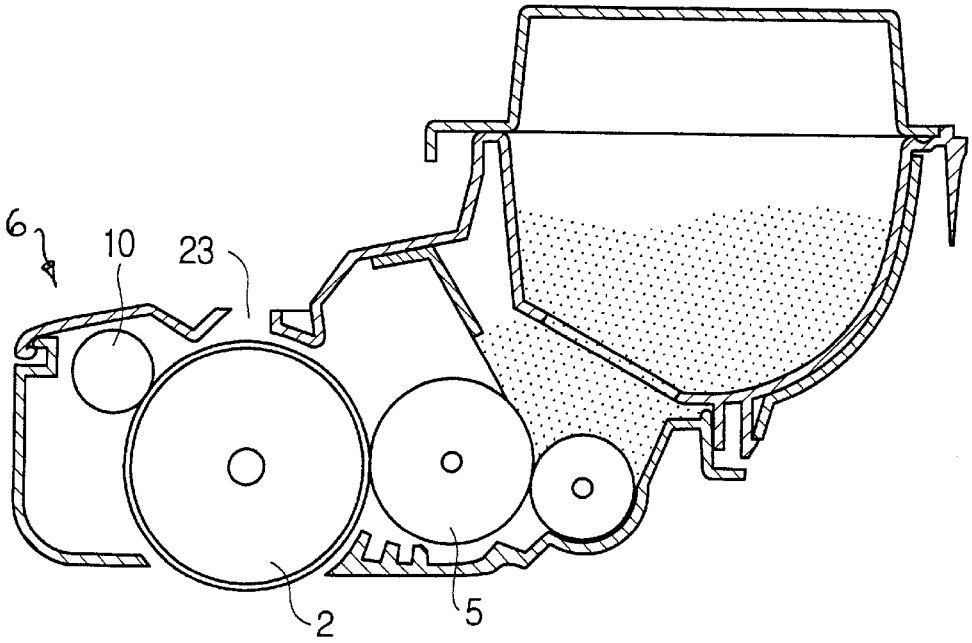
FIG. 3 is a sectional view illustrating another configuration of an image forming device.

In FIGS. 1 through 3, reference numeral 23 denotes the location of an exposure window for allowing an optical signal, scanned by either the laser scanning unit or LED array 1, to be transmitted into the interior of the developer cartridge 6. In the design of this cartridge 6 for an electrophotographic processor, however, a separate waste toner space is provided to receive waste toner T' within housing 7 of the developer cartridge 6 because the remaining toner attached to the surface of the OPC drum 2 is removed by using cleaning blade 15. The waste toner receiving space necessarily results in an increase in the volume of the developer cartridge 6; consequently, it is impossible to achieve a compactness in the design of the electrophotographic processor. In order to address this inability to attain compactedness, a technique has been proposed in which no cleaning blade is used. In accordance with this technique, toner particles left on the OPC drum 2 are recovered by developing roller 5 for reuse thereof without being wasted. Accordingly, this technique eliminates the drawback of providing a separate waste toner receiving space, thereby achieving a modicum of compactness of the electrophotographic processor.

I have found that this technique creates another problem however. Although toner particles, which are left on the surface OPC drum 2 while maintained in a negatively charged state, can be reused after being recovered by the developing roller 5, foreign matter that becomes attached to the copy sheet P while not in a negatively charged state can not be recovered by the developing roller 5. This foreign matter may adhere to the exterior surface of OPC drum 2, and later cause undesired white spots, that is, spots devoid of toner, on the printed image. As a result, a noticeable degradation in printing quality occurs. This adversely affects the performance of the electrophotographic processor, thereby severely degrading the reliability of the electrophotographic processor.

Figure 4:
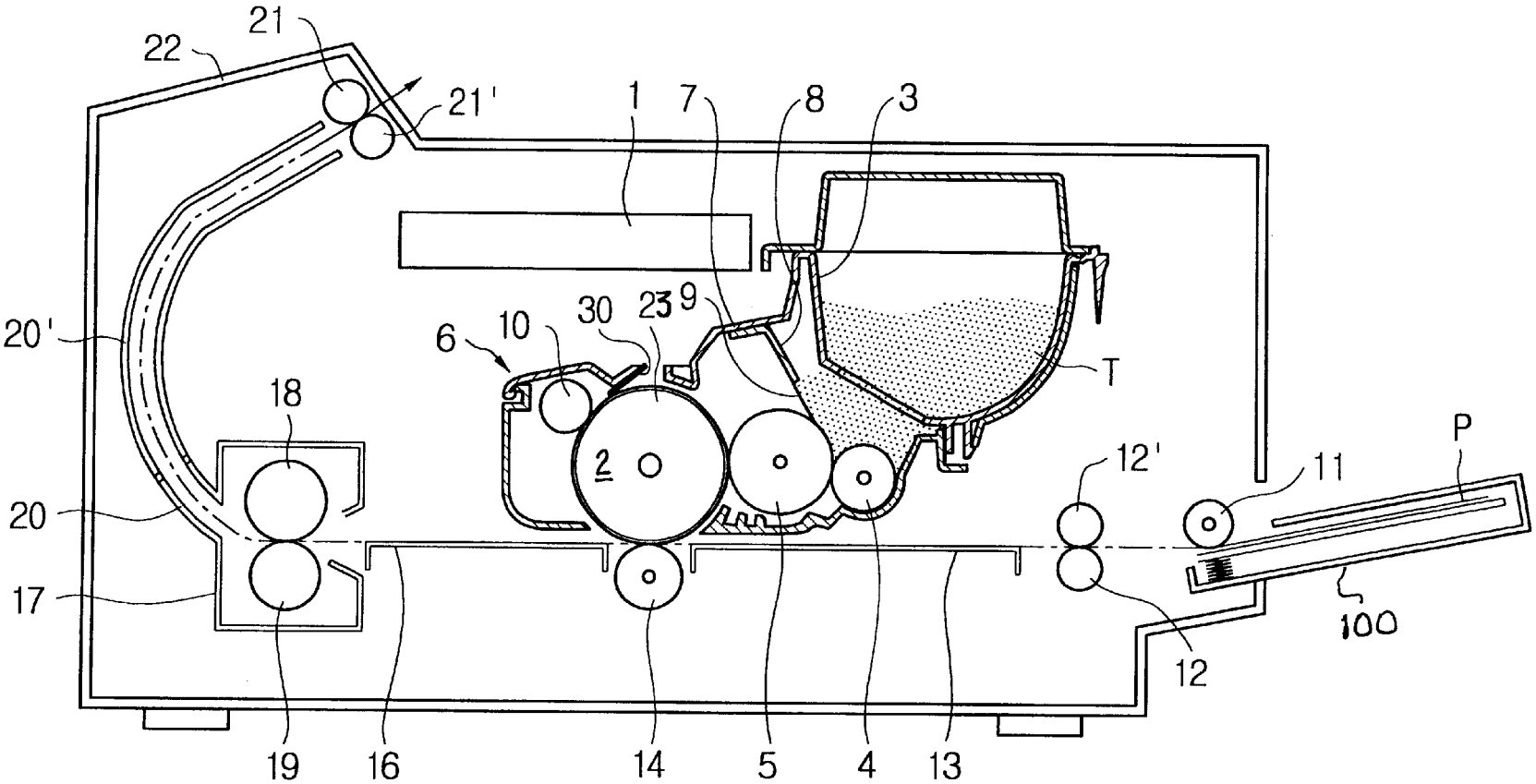
FIG. 4 is a schematic cross-sectional elevational view illustrating one configuration of an electrophotographic processor provided with an image forming device, constructed according to the principles of present invention.
Figure 5:
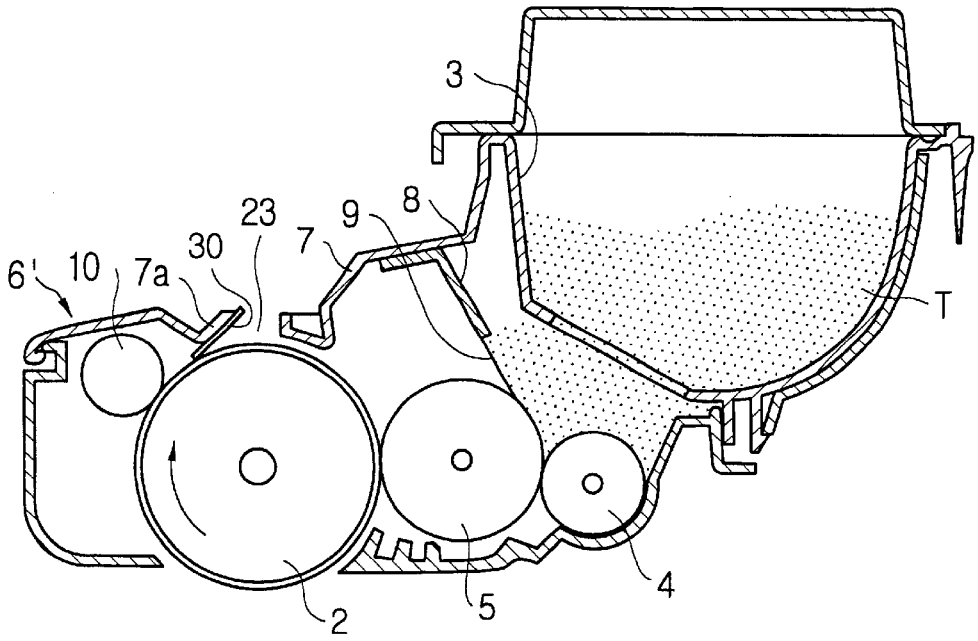
FIG. 5 is a sectional view illustrating one configuration of an image forming device constructed according to the principles of the present invention.
Figure 6:
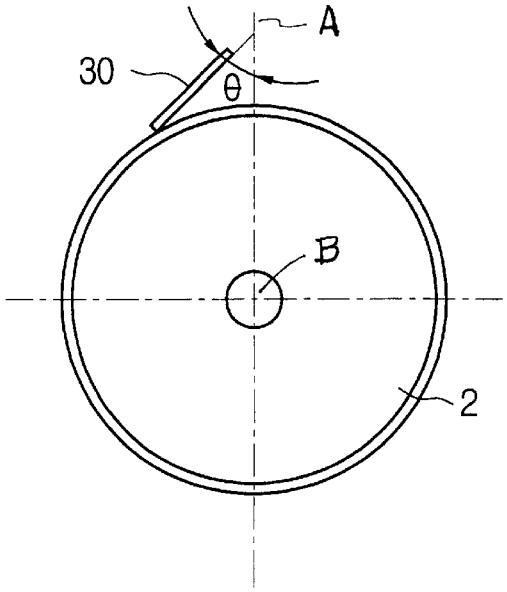
FIG. 6 is a schematic view illustrating an apparatus for cleaning an OPC drum in the image forming device in accordance with the present invention.
Figure 7:
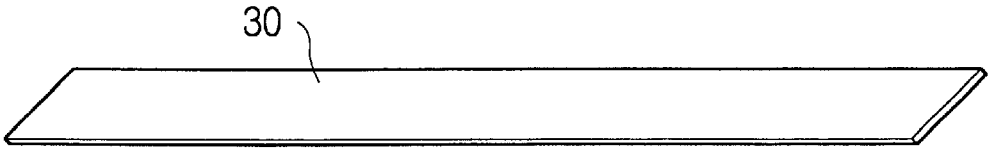
FIG. 7 is a perspective view illustrating a cleaning blade that may be incorporated into a drum cleaning apparatus in accordance with the principles of the present invention.

Turning now to FIGS. 4 and 5, an apparatus for cleaning an OPC drum in an electrophotographic processor in accordance with the present invention will be described with respect to embodiments illustrated in the annexed drawings. FIG. 4 is a schematic view illustrating the configuration of an electrophotographic processor provided with an image forming device constructed as one embodiment according to the principles of the present invention, while FIG. 5 is a sectional view illustrating a configuration of the image forming device according to the present invention, FIG. 6 is a schematic view illustrating an apparatus for cleaning an OPC drum in the image forming device in accordance with the present invention and FIG. 7 is a perspective view illustrating a cleaning blade included in the drum cleaning apparatus constructed according to the principles of the present invention. In FIGS. 4 through 7, elements respectively corresponding to those in FIGS. 1 to 3 are denoted by the same reference numerals, and are housed in developer cartridge 6'. A drum cleaning apparatus constructed according to the principles of the present invention may include a foreign matter removing member arranged along the arcuate path defined by the exterior circumferential surface of OPC drum 2 extending along an arc between charging roller 10 and exposure window 23 near an outlet of charging roller 10, that is adapted to remove foreign matter that adheres to the surface of OPC drum 2.

In accordance with an embodiment of the present invention, the foreign matter removing member may be constructed with a cleaning film 30 having a desired width, length, and thickness. Preferably, the cleaning film 30 is made of urethane and has a thickness within the range of between approximately 0.1 millimeter to 1.5 millimeter. Cleaning film 30 is arranged in such a fashion that it is in contact with the surface of the OPC drum 2 while maintaining an angle θ within the range of approximately 30° to 45° with respect to a vertical line passing diametrically through the center of OPC drum 2. The materials and dimensions of cleaning film 30 may be varied in accordance with a given environment without being limited to those in the above mentioned embodiment.

Cleaning film 30 is fixedly mounted on an inner wall 7*a* of exposure window 23, arranged near the outlet of the charging roller 10, by a well-known attachment such as an adhesive. The cleaning film 30 may extend across the entire axial length of the outer cylindrical surface of OPC drum 2. The position of the cleaning film 30 is not limited to the inner wall 7*a* of the exposure window 23. The cleaning film 30 may alternatively be fixedly mounted at an optional position on a developer housing 7 arcuately downstream from the charging roller 10 insofar as it can effectively remove foreign matter from the surface of the OPC drum 2 at that position. For instance, although the cleaning film 30 has been described as being directly mounted on the inner wall 7*a* of the exposure window 23 as shown in the illustrated embodiment of FIGS. 4 and 5, it may be mounted using a bracket or other mounting member that is either formed integrally with an inner surface of the housing 7 or formed separately from the inner surface of the housing 7.

The operation of the drum cleaning apparatus constructed in accordance with the foregoing principles such as are represented by the above mentioned configuration, will be described in conjunction with an image printer equipped with the drum cleaning apparatus. A digital signal received by the image printer from a computer, a scanner or a digital camera, is converted into an optical signal by either a laser scanning unit or a LED array 1. The optical signal is transmitted to the surface of the OPC drum 2 via the exposure window 23 of the developer housing 7. As a result, an electrostatic latent image corresponding to the content of the digital signal is formed on the exterior circumferential surface of OPC drum 2, based on the optical signal. At this time, toner particles T contained in a toner hopper 3 are fed to a developing roller 5 by a supply roller 4 while being negatively charged by the supply roller 4. As the developing roller 5 rotates, the toner particles T are fed to a developing nip defined by an axial engagement between the tangential exterior circumferential surfaces of OPC drum 2 and developing roller 5. The operation of doctor blade 9 maintains the thickness of the layer of toner particles T fed to the developing nip to a constant thickness on the exterior circumferential surface of developing roller 5. As the OPC drum 2 rotates clockwise as shown in FIGS. 4, 5 and 6, the exterior circumferential surface of drum 2 attracts the negatively charged toner particles T borne by the exterior circumferential surface of developing roller 5 at the developing nip, thereby causing the toner particles T to be attached to the electrostatic latent image on the OPC drum 2. As a result, a visual toner image is formed on the surface of the OPC drum 2.

In accordance with practice of the present invention using the drum cleaning apparatus, toner particles T that are left on the exterior circumferential surface of OPC drum 2 without being transferred to a copy sheet P after passing by a transfer roller 14, are recovered, for reuse by developing roller 5 without being removed by the cleaning film 30 because the cleaning film 30 is fixedly attached to the inner wall 7*a* of the exposure window 23 between the charging roller 10 and the exposure window 23 in such a fashion that the distal end of cleaning film 30 is in contact with the exterior circumferential surface of OPC drum 2 while maintaining an angle θ within the range extending between approximately 30° to 45° with respect to the vertical line A passing diametrically through the center axis B of the OPC drum 2. On the other hand, foreign matter transferred from the copy sheet P to the OPC drum 2 and attached to the surface of the OPC drum 2 are removed by the cleaning film 30. Accordingly, there is no further foreign matter affixed to the OPC drum 2. Since the cleaning film 30 is mounted on the inner wall 7*a* of the exposure window 23 near the outlet of the charging roller 10, cleaning film 30 does not have any influence on the uniformity of the surface potential of OPC drum 2 after the OPC drum 2 has been uniformly charged by virtue of the discharge of the charging roller 10. The remaining operational procedures performed by the electrophotographic processor, that is, processes for supplying, conveying and discharging copy sheets P, are carried out in the same fashion as those in well-known electrophotographic processors. Therefore, no farther description will be made in conjunction with those procedures.

The foregoing paragraphs describe the details of an apparatus for cleaning an organic photosensitive (OPC) drum in an image forming device such as a laser beam printer, an LED printer, a facsimile machine, or a digital copying machine, that advantageously prevents degradation in printing quality caused by foreign matters adhered to the surface of the OPC drum, thus enabling the printing of matter of high quality while achieving an improvement in performance resulting in an improved reliability. As is apparent from the details of the description, a drum cleaning apparatus constructed according to the principles of the present invention includes a cleaning film arranged between a charging roller received in a developer housing and an exposure window in such a fashion that it is in contact with the surface of the OPC drum 2 and adapted to remove foreign matter affixed to the surface of the OPC drum. Consequently, the drum cleaning apparatus is able to avoid a degradation in printing quality from occurring foreign matter that otherwise tends to adhere to the surface of the OPC drum, thereby assuring an enhanced quality of printed matter. Also, the drum cleaning apparatus can improve the performance of the electrophotographic processor, thereby achieving an improvement in the reliability of the electrophotographic processor.

Although the preferred embodiments of the drum cleaning apparatus in the electrophotographic process in accordance with the present invention have been disclosed for illustrative purposes, those skilled in the art will appreciate that various modifications, additions and substitutions are possible, without departing from the scope and spirit of the invention as disclosed in the accompanying claims.

What is claimed is:

1. In an image forming apparatus including a developer housing formed with an exposure window at a desired portion thereof and contained therein with an organic photosensitive drum, a developing roller, and a charging roller, the developing roller being configured to recover toner particles left on an outer surface of the organic photosensitive drum for reuse thereof, an apparatus for cleaning the organic photosensitive drum comprising:

means arranged between the charging roller and the exposure window while being in contact with the outer surface of the organic photosensitive drum, the means serving to remove foreign matter affixed to the outer surface of the organic photosensitive drum.

2. The apparatus according to claim 1, wherein the foreign matter removing means comprises a film fixedly mounted to an inner wall of the exposure window at one end thereof, the film being in contact with the outer surface of the organic photosensitive drum at the other end thereof.

3. The apparatus according to claim 2, wherein the film is arranged in such a fashion that it maintains an angle of 30° to 45° with respect to a vertical line passing through the center of the organic photosensitive drum.

4. The apparatus according to claim 2, wherein the film extends throughout the length of the outer surface of the organic photosensitive drum.

5. The apparatus according to claim 2, wherein the film is made of urethane.

6. The apparatus according to claim 2, wherein the film has a thickness of 0.1 to 1.5 mm.

7. The apparatus of claim 1, further comprised of:

said foreign matter removing means comprising a distal end providing said contact; and said developer housing orienting said foreign matter removing means to form a tangent to said outer surface along an axial line where said distal end provides said contact.

8. An image forming apparatus, comprising:

a developer housing formed with an exposure window;

an organic photosensitive drum located within said housing;

a developing roller configured to recover toner particles left on an outer surface of the organic photosensitive drum for reuse located within said housing;

a charging roller located within said housing; and an apparatus for cleaning said organic photosensitive drum, comprising a blade positioned between said charging roller and said exposure window while a distal end of said blade is in contact with said outer surface of said organic photosensitive drum, said housing orienting said blade to engage and remove from said outer surface foreign matter adhering to said outer surface of said organic photosensitive drum.

9. The apparatus according to claim 8, with said blade comprised of a film mounted on an inner wall of said exposure window, with said distal end of said film being in contact with said outer surface of said organic photosensitive drum.

10. The apparatus according to claim 8, further comprised of said film being oriented to maintain an angle within a range of approximately of 30° to 45° with respect to a vertical line passing diametrically through a central axis of said organic photosensitive drum.

11. The apparatus of claim 7, further comprised of said developer housing orienting said blade to form a tangent to said outer surface along an axial line where said distal end engages said outer surface.

12. The apparatus according to claim 8, further comprised of said blade being oriented to maintain an angle within a range of approximately of 30° to 45° with respect to a vertical line passing diametrically through a central axis of said organic photosensitive drum.

13. An image forming apparatus, comprising:

a developer housing formed with an exposure window;

an organic photosensitive drum located within said housing;

a developing roller positioned to recover toner particles from an outer surface of the organic photosensitive drum for reuse located within said housing;

a charging roller located within said housing; and a blade positioned between said charging roller and said exposure window while a distal end of said blade engages said outer surface of said organic photosensitive drum, said developer housing orienting said blade to form a tangent to said outer surface along an axial line where said distal end engages said outer surface and remove foreign matter adhering to said outer surface of said organic photosensitive drum.

14. The apparatus according to claim 13, with said blade comprised of a film mounted on an inner wall of said exposure window, with said distal end of said film being in contact with said outer surface of said organic photosensitive drum.

15. The apparatus according to claim 14, further comprised of said film being oriented to maintain an angle within a range of approximately of 30° to 45° with respect to a vertical line passing diametrically through a central axis of said organic photosensitive drum.

16. The apparatus according to claim 13, further comprised of said blade being oriented to maintain an angle within a range of approximately of 30° to 45° with respect to a vertical line passing diametrically through a central axis of said organic photosensitive drum.

* * * * *